US009628913B2

(12) United States Patent
Miller et al.

(10) Patent No.: US 9,628,913 B2
(45) Date of Patent: Apr. 18, 2017

(54) SUPPORT STAND AND WIRELESS SPEAKER SYSTEM FOR TABLET COMPUTING DEVICE

(71) Applicants: Garold C. Miller, Glastonbury, CT (US); Nathan Daniel Weinstein, Glastonbury, CT (US)

(72) Inventors: Garold C. Miller, Glastonbury, CT (US); Nathan Daniel Weinstein, Glastonbury, CT (US)

(73) Assignee: Halo2Cloud LLC, Hartford, CT (US)

( * ) Notice: Subject to any disclaimer, the term of this patent is extended or adjusted under 35 U.S.C. 154(b) by 902 days.

(21) Appl. No.: 13/683,081

(22) Filed: Nov. 21, 2012

(65) Prior Publication Data

US 2014/0140557 A1 May 22, 2014

(51) Int. Cl.

| | |
|---|---|
| ***H04R 1/02*** | (2006.01) |
| ***H04R 9/06*** | (2006.01) |
| ***H04R 5/00*** | (2006.01) |

(52) U.S. Cl.

CPC ..... *H04R 5/00* (2013.01); *H04R 1/025* (2013.01); *H04R 2205/021* (2013.01); *H04R 2420/07* (2013.01)

(58) Field of Classification Search

CPC H04R 5/00; H04R 2420/07; H04R 2205/021; H04R 5/02; H04R 2499/15; H04R 1/025

USPC ..... 381/333, 334, 332, 87, 386, 388; 455/456.1, 550.1, 151.2, 3.06, 3.01; 361/679.23, 679.41, 679.26; 248/436, 248/917, 918, 919, 920, 921, 922, 923, 248/924, 121.1, 123.11, 123.2, 124.1, 248/124.2, 125.1, 125.2, 125.3, 125.7, 248/125.8, 125.9, 167, 166, 163.1

See application file for complete search history.

(56) References Cited

U.S. PATENT DOCUMENTS

| | | | | |
|---|---|---|---|---|
| D535,978 | S | 1/2007 | Hussaini et al. | |
| D556,212 | S | 11/2007 | Hussaini et al. | |
| D666,614 | S | 9/2012 | Ding | |
| D685,366 | S | 7/2013 | Ding | |
| 8,567,740 | B2 * | 10/2013 | Tarnutzer et al. | 248/456 |
| 2009/0179124 | A1 * | 7/2009 | Caplan | A47B 23/044 248/176.1 |
| 2011/0131358 | A1 * | 6/2011 | Ganesh et al. | 710/304 |

* cited by examiner

*Primary Examiner* — Vivian Chin
*Assistant Examiner* — Con P Tran
(74) *Attorney, Agent, or Firm* — McCormick, Paulding & Huber LLP

(57) ABSTRACT

A combination support stand and speaker system is provided for supporting a portable electronic device, such as a tablet computing device, a smart phone, or a portable music player, to facilitate the display and transmission of multimedia content from the electronic device. In general, a support stand is provided for holding an electronic device, where the support stand has a set-up condition for supporting an electronic device in a desired orientation and a folded condition for easy transport and/or storage of the stand. Additionally, the support stand includes a speaker system that is operatively connected to an electronic device supported by the stand, for example through a wireless interface, to transmit audio signals through at least one speaker.

18 Claims, 10 Drawing Sheets

SUPPORT STAND AND WIRELESS SPEAKER SYSTEM FOR TABLET COMPUTING DEVICE

TECHNICAL FIELD

The present invention generally relates to accessories for portable electronic devices, and more particularly to a combination support stand and speaker system for displaying and transmitting multimedia content from portable electronic devices, such as tablet computing devices, smart phones, portable music players, and the like.

BACKGROUND OF THE INVENTION

Portable electronic devices, such as tablet computing devices, smart phones, media players, and the like, have become familiar conveniences due to ease of use, portability, and increased functionality and connectivity for a variety of uses, including making phone calls, sending text messages and emails, video conferencing, listening to music, watching videos, social networking, and connecting to the Internet. Yet in many situations, handheld use of such devices can render the device inconvenient when the device must be held for long periods of time. For example, tablet computing devices are increasingly being used to watch movies and videos, or to communicate with others through video conferencing technology. During such uses, it is often tiresome to hold the device in one's hands for long stretches. However, setting the device flat on a table or other surface makes it difficult to see the screen. Propping the device up on other objects increase the risk of damaging the device if it or its makeshift support slips or collapses. More pragmatically, it is exceedingly difficult to perform other tasks, or carry other objects while also holding and using a portable electronic device—for example, watching a movie on a tablet device while trying to prepare dinner.

Support stands have been developed to hold and support certain portable electronic devices in an upright position for convenient use. For example, carrying cases or protective sleeves have been designed for certain tablet computing devices, where the case or sleeve can be transformed into a support stand. However, such support stands are often usable only with a specific electronic device design, and cannot be adapted for use with other devices having different shapes and sizes. Moreover, such prior art support stands typically do not provide added capabilities that improve the use of portable electronic devices to display and transmit multimedia content, such as, for example, speakers that can project audio signals from an electronic device when watching a movie, listening to music, or videoconferencing.

In view of the foregoing, there is a need for a support stand for supporting portable electronic devices, such as tablet computing devices, smart phones, portable music players, and the like, to facilitate the display and transmission of multimedia content from such devices. Additionally, there is a need for such a support stand that is provided in a compact size for transport or storage, and further, for a support stand that can be easily converted from a compact size to a set-up condition for holding and supporting an electronic device in a position that is advantageous for intended use of the device for display and transmission of multimedia content, and further be adjusted to a variety of set-up conditions for holding and supporting electronic devices of different shapes and sizes. Still further, there is a need for a support stand that also includes a wireless speaker system for displaying and transmitting multimedia content when a portable electronic device is supported by the stand, including audio signals transmitted through the speaker system. Accordingly, it is a general object of the present invention to provide a combination support stand and speaker system for use with portable electronic devices that improves upon support stands currently on the market and that overcomes the problems and drawbacks associated with such prior art stands.

SUMMARY OF THE INVENTION

In accordance with the present invention, a combination support stand and speaker system is provided for supporting a portable electronic device, such as a tablet computing device, a smart phone, or a portable music player, to facilitate the display and transmission of multimedia content from the electronic device. In general, a support stand is provided for holding an electronic device, where the support stand has a set-up condition for supporting an electronic device in a desired orientation and a folded condition for easy transport and/or storage of the stand. Additionally, the support stand includes a speaker system that is operatively connected to an electronic device supported by the stand to transmit audio signals through at least one speaker.

In a first aspect of the present invention, a support stand for displaying and transmitting multimedia content from a portable electronic device comprises a first support member for supporting a lower portion of the electronic device and a second support member pivotally connected to the first support member and adjustable to a plurality of positions relative to the first support member for supporting an upper portion of the electronic device. The support stand also includes at least one speaker disposed in the support stand that is wirelessly connectable to the electronic device via a wireless interface.

In another aspect of the present invention, a combination support stand and speaker system for displaying and transmitting multimedia content from a portable electronic device comprises a stand having a base portion adapted to support the lower portion of an electronic device and an arm portion pivotally connected to the base portion adapted to support an upper portion of the electronic device when the arm is pivoted away from the base portion to a generally upwardly extending position relative to the base portion. At least one speaker is provided in the base portion for operative connection with the electronic device that is supported by the stand, preferably via a wireless interface, for projection of audio signals transmitted from the electronic device through the at least one speaker.

In preferred embodiments of the support stand, the base portion comprises first and second sections that are pivotally connected to one another at a common pivot point and moveable between a first position where the first and second sections are generally parallelly disposed and a second position where respective distal ends of the first and second sections are transversely spaced apart from one another. Each of the first and second sections may include a speaker.

The arm portion of the support stand may comprise first and second sections connected by an intermediate pivot that allows the arm portion to be bent in order to accommodate electronic devices of varying shapes and sizes.

Preferably, the speaker system is wirelessly connected to electronic devices for wireless transmission of audio signals from the electronic devices to the support stand, such as through a Bluetooth® or similar network. In this regard, the combination support stand and speaker system includes a wireless interface that can be paired with several different devices for use as desired.

In operation, the support stand is used to prop up and support an electronic device for display and transmission of multimedia content from the electronic device, for example, from the device's screen, when the device is positioned on the support stand. The support stand includes at least one set-up condition designed for holding an electronic device, regardless of the device's size or shape. In accordance with embodiments of the present invention, a first set-up position comprises the arm portion being pivoted away from the base portion to a generally upwardly extending position relative to the base portion, whereby the base portion supports the bottom of an electronic device held by the support stand and the arm portion supports the back of the electronic device. In accordance with additional embodiments of the present invention, a second set-up position comprises the first and second sections of the base portion being transversely pivoted away from one another, whereby the base portion supports the bottom of an electronic device held by the support stand and the arm portion supports the back of the electronic device.

When the support stand is not needed, it can be collapsed to a folded condition for easy transport and/or storage. In accordance with embodiments of the present invention, the folded condition of the support stand comprises the arm portion being pivoted to a position adjacent to and generally parallel to the base portion, preferably nested on top of the base portion. Where the base portion comprises first and second sections, the sections are pivoted together when the support stand is in its folded condition.

These and other objects, features and advantages of the present invention will become apparent in light of the detailed description of embodiments thereof, as illustrated in the accompanying drawings.

DETAILED DESCRIPTION OF EMBODIMENTS OF THE INVENTION

Figure 1:
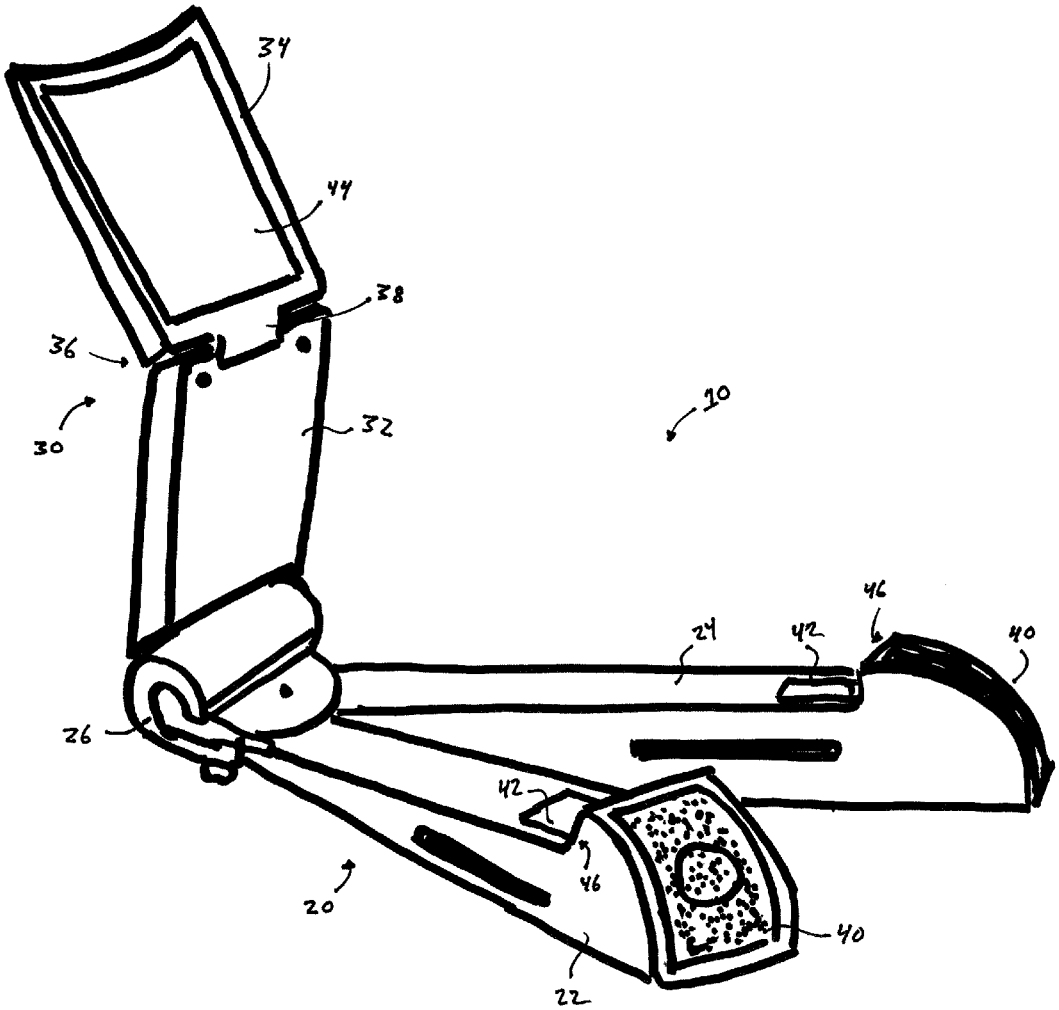
FIG. 1 shows a perspective view of a support stand in accordance with the present invention with the support stand being in a set-up condition.
Figure 2:
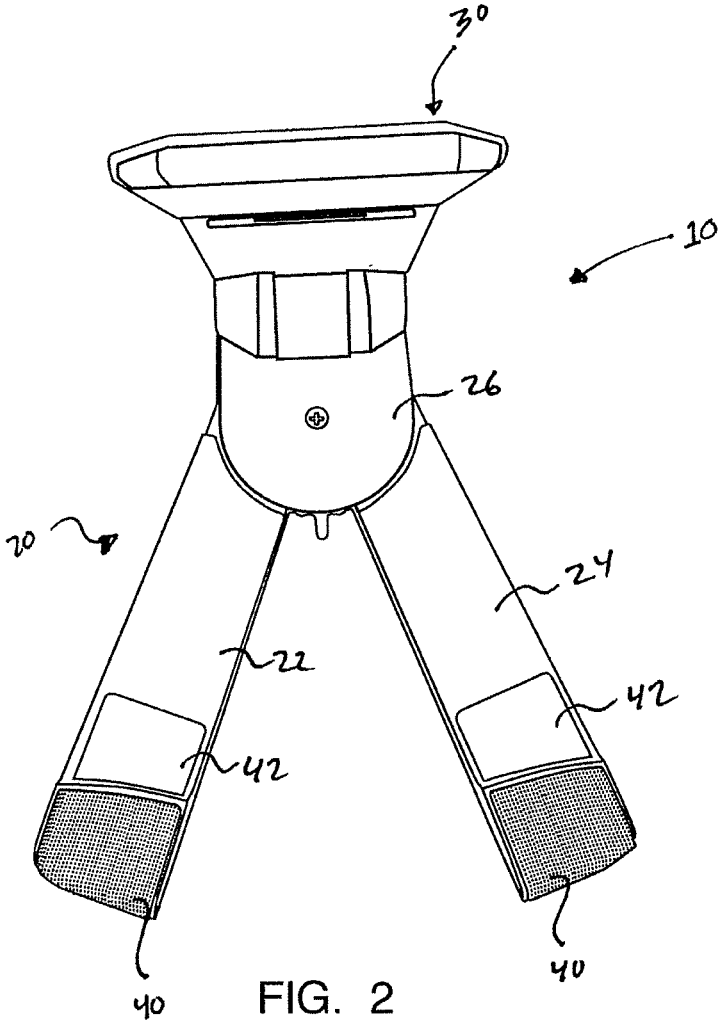
FIG. 2 shows a planar top view of the support stand of FIG. 1.
Figure 3:
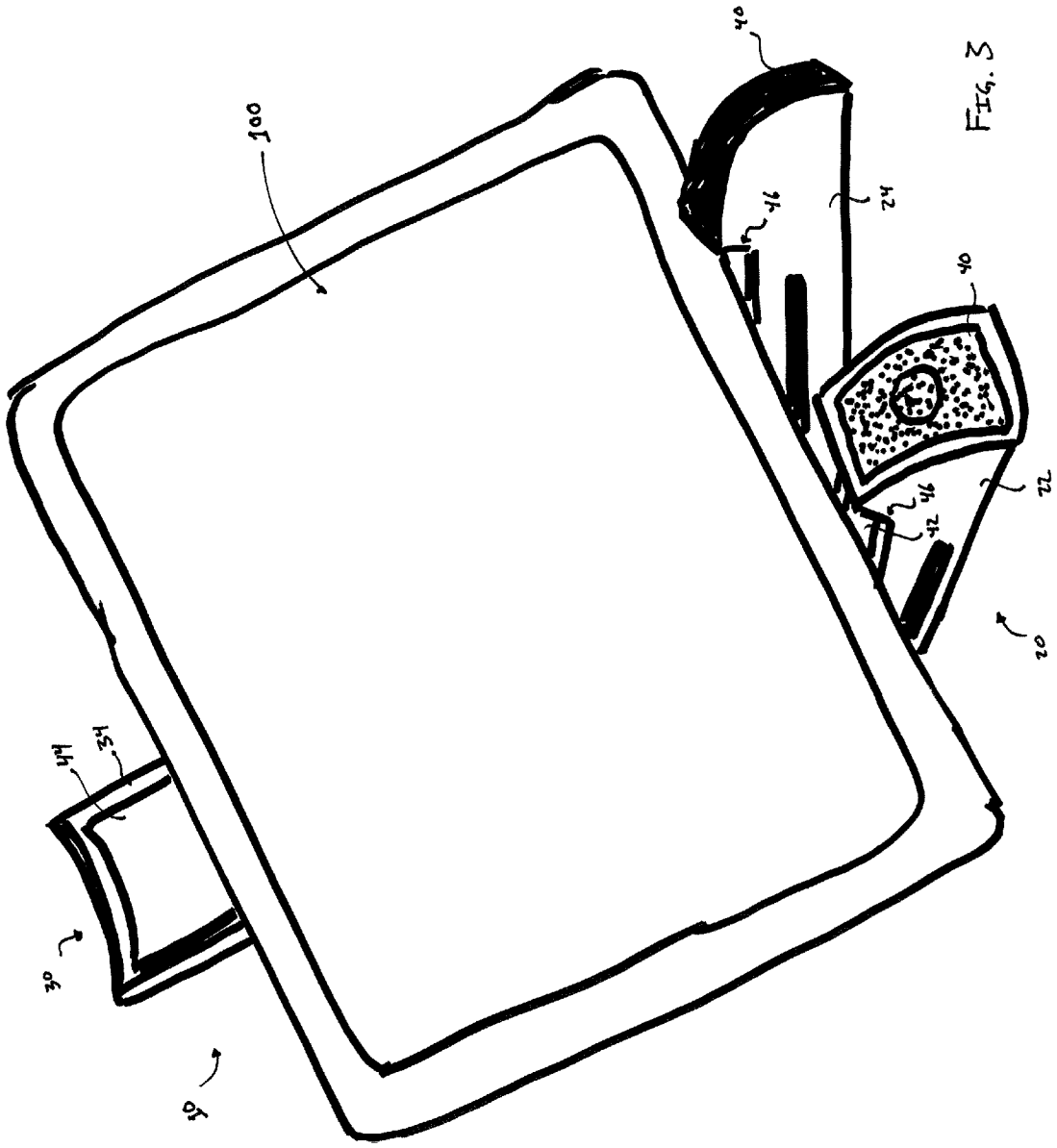
FIG. 3 shows a perspective view of the support stand of FIG. 1 holding a tablet computing device.
Figure 4:
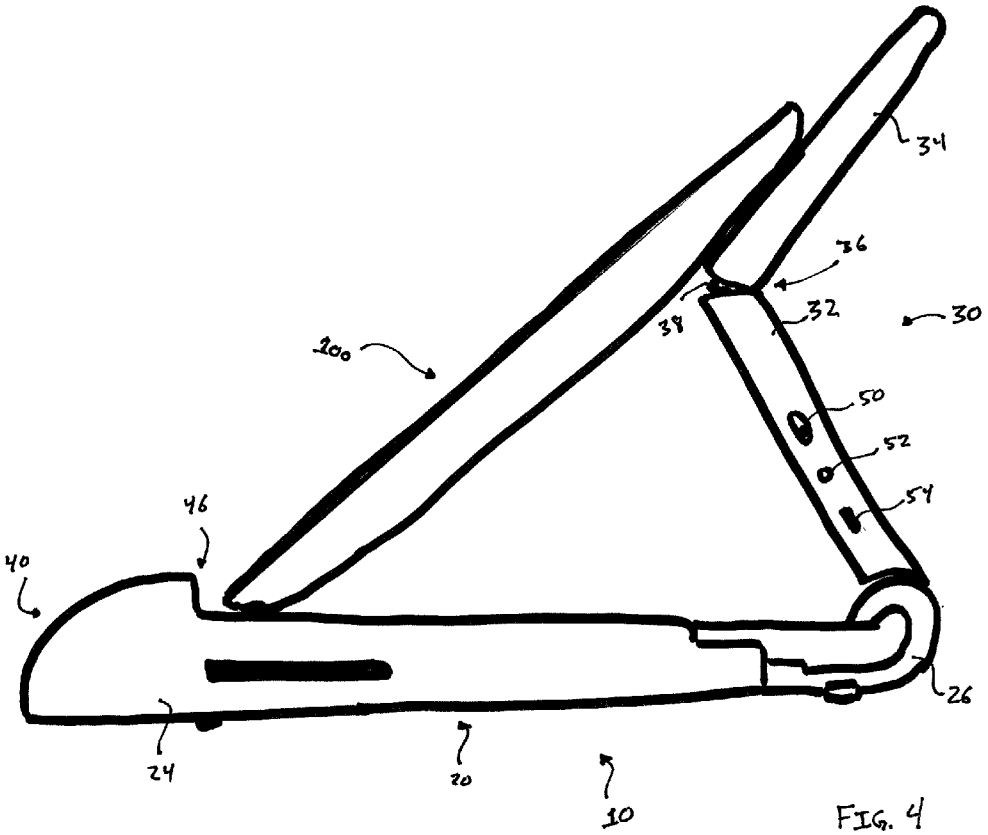
FIG. 4 shows a planar side view of the support stand of FIG. 1 holding a tablet computing device.
Figure 6:
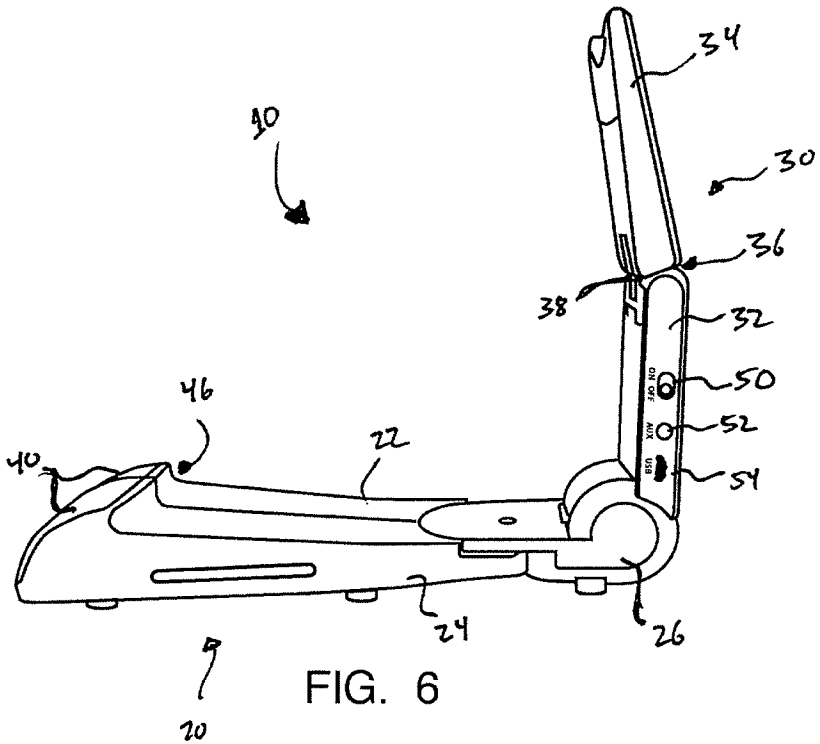
FIG. 6 shows a planar side view of the support stand of FIG. 1 in the set-up condition of FIG. 5.
Figure 7:
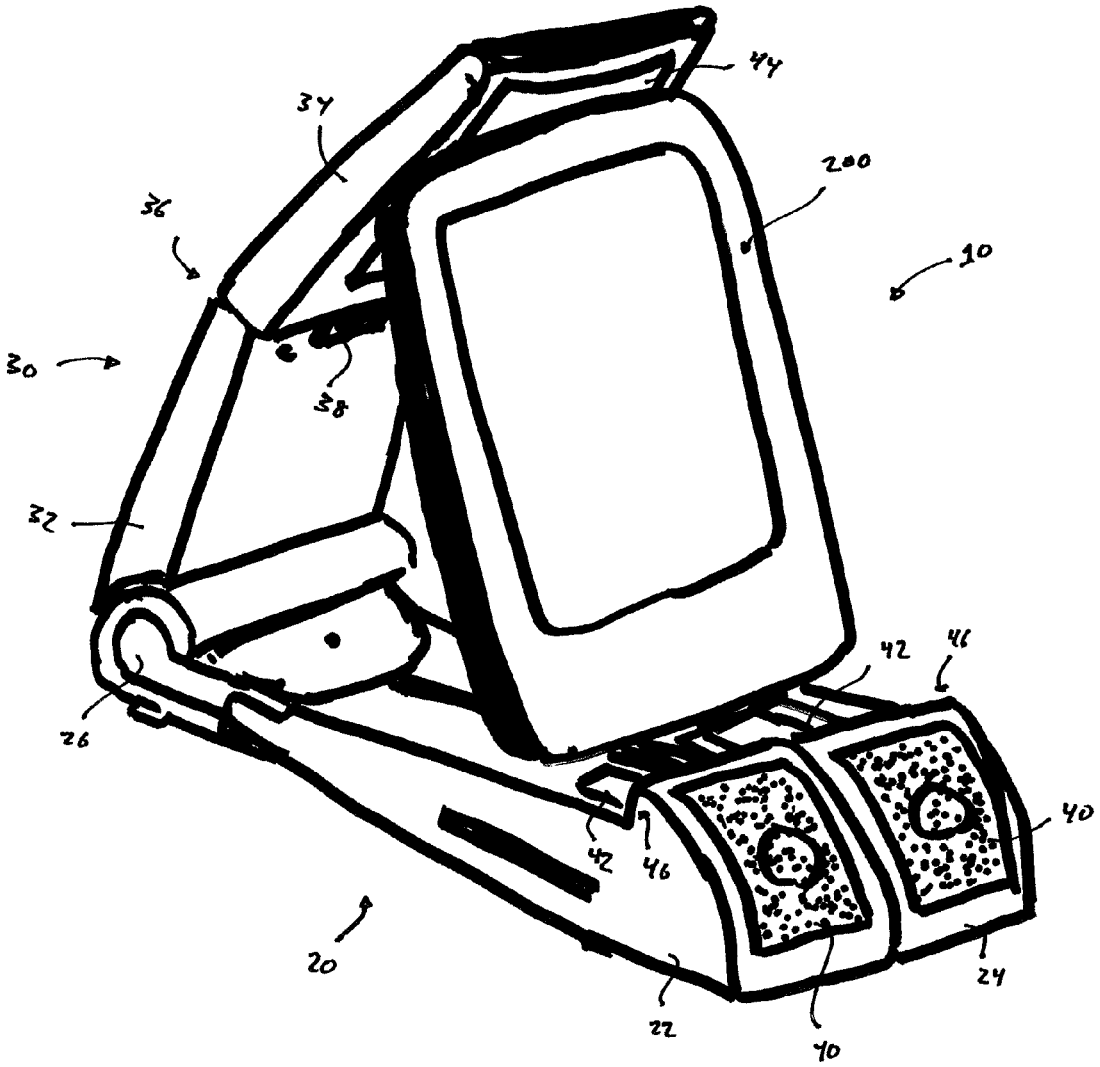
FIG. 7 shows a perspective view of the support stand of FIG. 1 in the set-up condition of FIG. 5 holding a smart phone.
Figure 8:
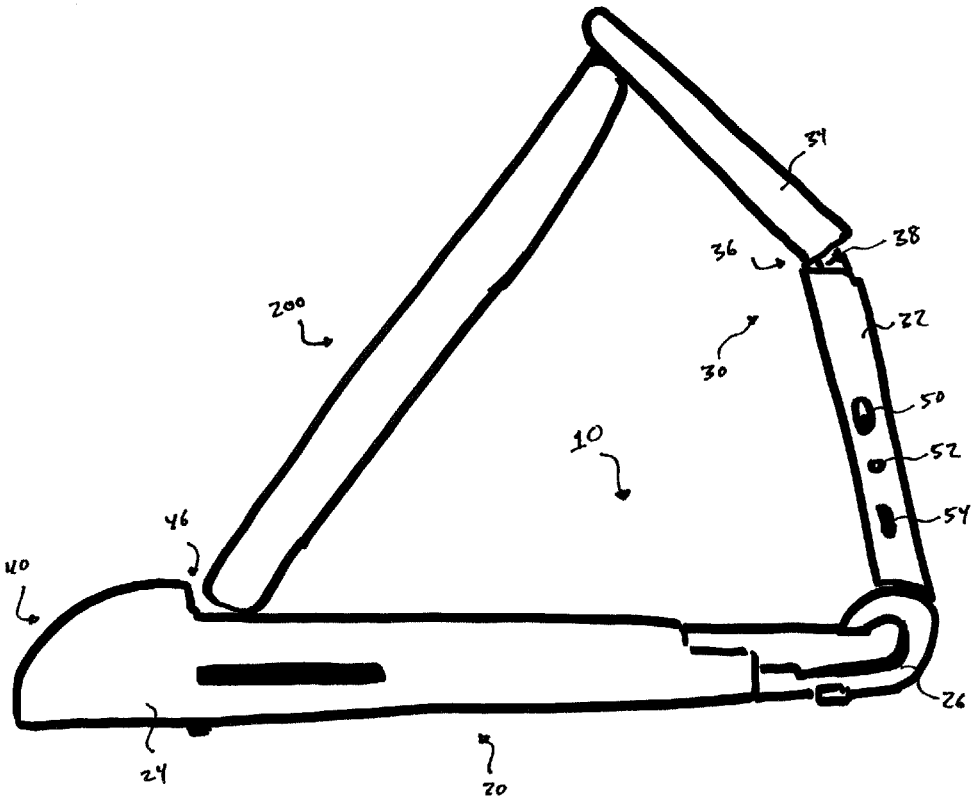
FIG. 8 shows a planar side view of the support stand of FIG. 1 in the set-up condition of FIG. 5 holding a smart phone.
Figure 9:
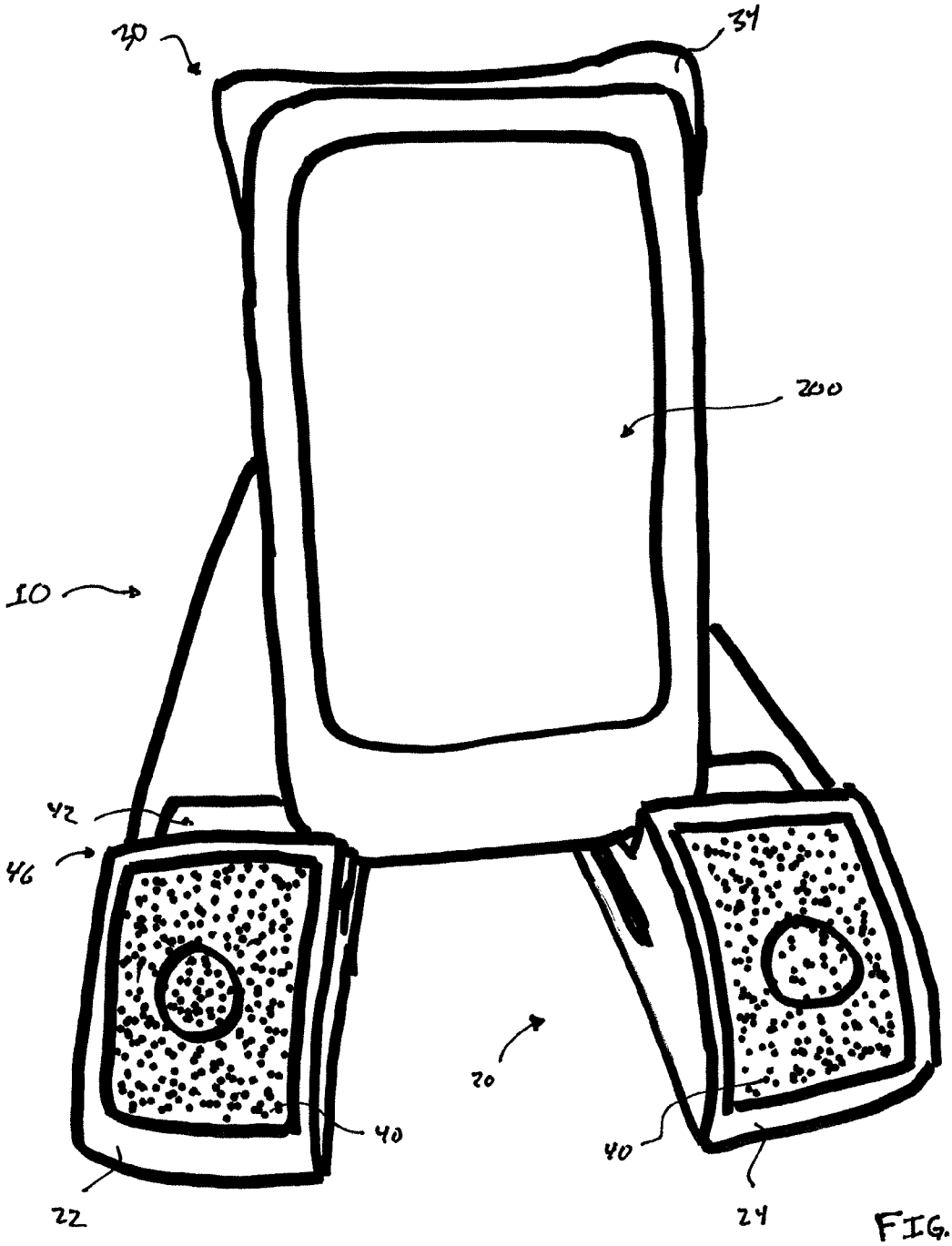
FIG. 9 shows another alternate set-up condition of the support stand of FIG. 1.
Figure 10:
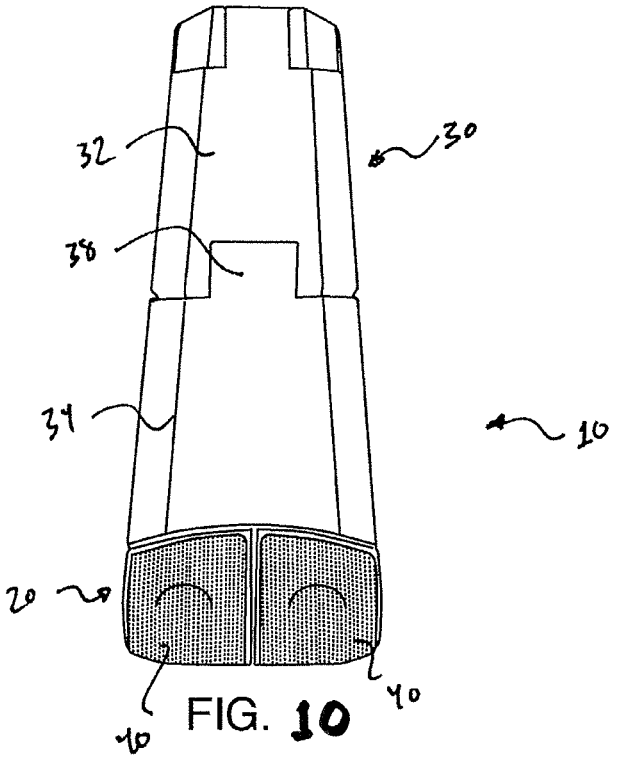
FIG. 10 shows a planar top view of the support stand of FIG. 1 in a folded condition.
Figure 11:
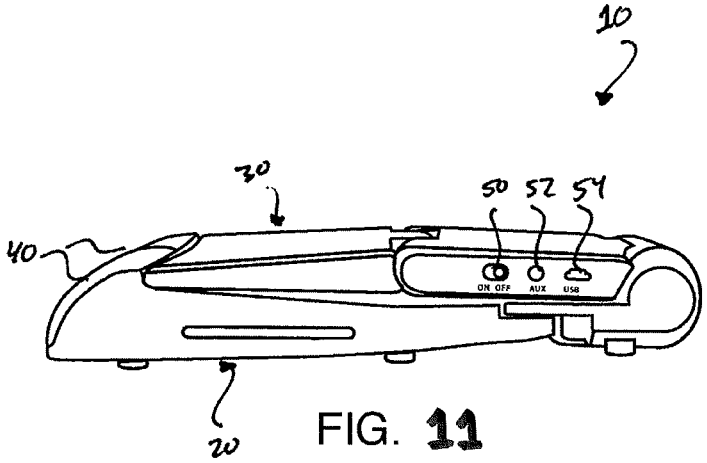
FIG. 11 shows a planar side view of the support stand of FIG. 1 in the folded condition of FIG. 10.

FIGS. 1-11 illustrate an exemplary embodiment of a support stand 10 in accordance with the present invention, and more particularly a combination support stand and speaker system for displaying and transmitting multimedia content from portable electronic devices, such as tablet computing devices, smart phones, portable music players, and the like. As shown, the support stand 10 is designed to hold and support an electronic device in a desired orientation when the support stand 10 is in a set-up condition. More particularly, a support stand 10 in accordance with preferred embodiments of the present invention may have several set-up conditions so as to easily accommodate a variety of portable electronic devices regardless of size and shape. For example, FIGS. 3-4 illustrate a set-up condition of the support stand 10 for propping up and holding a tablet computing device 100. By comparison, FIGS. 7-8 illustrate an alternate set-up condition of the support stand 10 for propping up and holding a smart phone or a portable music player, generally designated by reference numeral 200. FIG. 9 shows another alternate set-up condition of the support stand 10 for propping up and holding a smart phone or a portable music player. The support stand 10 further includes a folded condition, such as illustrated in FIGS. 10-11, for easy transport and/or storage of the support stand 10.

Referring to FIGS. 1-4, the support stand 10 comprises a base portion 20 adapted to support the lower portion of an electronic device and an arm portion 30 pivotally connected to the base portion 20 adapted to support the upper portion of the electronic device when the arm portion 30 is pivoted away from the base portion 20 to a generally upwardly extending position relative to the base portion 20, such as shown in FIG. 1. In preferred embodiments of the support stand 10, the base portion 20 comprises first and second sections 22 and 24 that are pivotable relative to one another via a common pivot point and moveable between a first position, shown in FIG. 5, where the first and second sections 22 and 24 are generally parallelly disposed, and a second position, shown in FIG. 2, where respective distal ends of the first and second sections 22 and 24 are transversely spaced apart from one another. As illustrated, the common pivot point is defined by a rear section 26 of the base portion 20 to which each of the first and second sections 22 and 24 are pivotally connected for movement about a generally vertical axis.

The respective positions of the first and second sections 22 and 24 of the base portion 20 are suited to holding electronic devices of different shapes and sizes. For example, when the first and second sections 22 and 24 are pivotally spaced apart from one another, they provide a wider footprint for the support stand 10 that can accommodate large devices, such as the tablet computing device 100 shown being supported on the support stand 10 in FIGS. 3-4. If such a tablet device 100 were positioned on the support stand 10 in the set-up condition shown in FIGS. 5-6, the device may be prone to tipping over or falling off of the support stand 10, especially if it were positioned too far to one side or the other. However, the set-up condition shown in FIGS. 5-6, where the first and second sections 22 and 24 of the base portion 20 are positioned side-by-side, is more suitable for holding smaller and narrower devices, such as a smart phone or a portable music player as shown in FIGS.

7-8. If such device 200 were positioned on the set-up condition shown in FIGS. 1-2, it would be susceptible to falling between the spaced-apart first and second sections 22 and 24. Accordingly, the support stand 10 of the present invention provides adaptability for use with electronic devices of different shapes and sizes by being movable to a plurality of set-up positions between the first position and the second position.

Alternatively, another set-up condition, where the first and second sections 22 and 24 of the base portion 20 are separated—though not as far apart as shown in FIGS. 3-4—can be used if desired to hold an electronic device, as shown in FIG. 9.

The arm portion 30 of the support stand 10 may also comprise first and second sections 32 and 34, interconnected by an intermediate pivot 36, that allow the arm portion 30 to be bent in order to accommodate electronic devices of varying shapes and sizes. As illustrated in FIG. 6, the first section 32 of the arm portion 30 is pivotally attached to the rear section 26 of the base portion 20 for pivotal movement about a generally horizontal axis. The second section 34 of the arm portion 30 is pivotally connected to the first section 32 via a hinge 38 for relative pivotal movement about a similarly generally horizontal axis.

Figure 12:
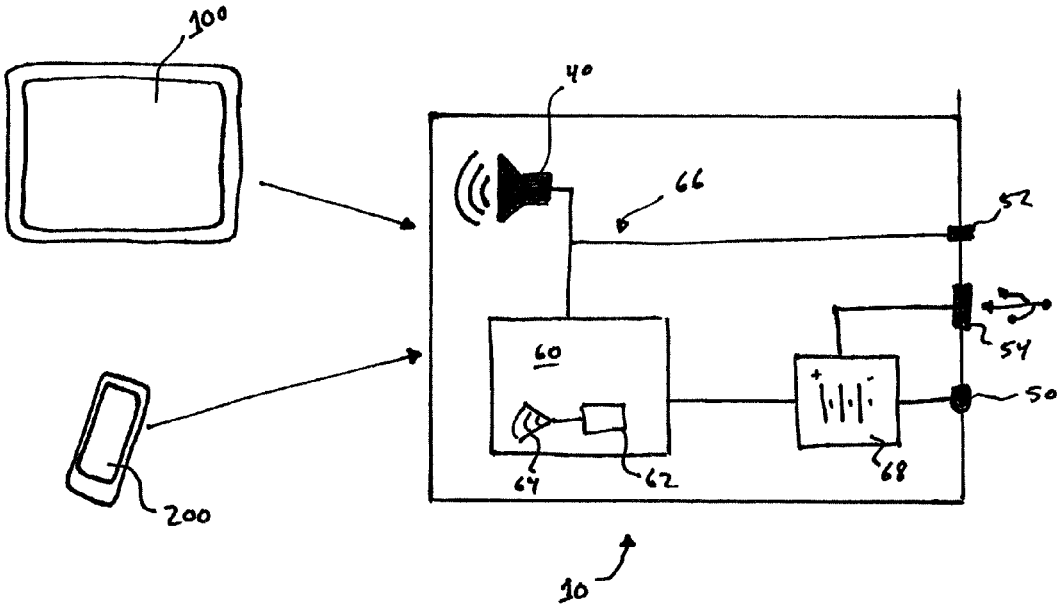
FIG. 12 shows a schematic view of internal components of a support stand in accordance with the present invention.

The support stand 10 also includes a speaker system that is operatively connected to an electronic device supported by the stand 10 to transmit audio signals through at least one speaker, such as is schematically illustrated in FIG. 12. In general, the speaker system comprises at least one speaker that is provided in the base portion 20 for operative connection with an electronic device that is supported by the stand 10 for projection of audio signals transmitted from the electronic device through the at least one speaker.

Referring to FIG. 1, a speaker 40 is provided in each section 22 and 24 of the base portion 20. Preferably, each speaker 40 is wirelessly connected to electronic devices for wireless transmission of audio signals from the electronic devices to the support stand 10, such as through a Bluetooth® or similar short-range wireless network. In this regard, the combination support stand and speaker system of the present invention includes a wireless interface 60, comprising a Bluetooth® transceiver 62 and antenna 64, as shown in FIG. 12, that can be paired with various different devices for use as desired. In operation, when the support stand 10 is paired to an electronic device, audio signals transmitted from the electronic device, such as music or the audio content of a movie, video or videoconference, are received by the wireless interface 60 and sent to the speakers 40 via an audio circuit 66 for projection to a user via the speakers 40.

In preferred embodiments of the present invention, the support stand 10 creates a compact theater whereby a portable electronic device, such as a tablet computing device, a smart phone, or a portable music player, can be propped up on the support stand 10 for a user to view multimedia content on the device's screen, as desired, whereby the audio signals from the electronic device are transmitted, and indeed amplified in some regards, by a speaker system provided on the support stand 10. In intended uses, a user can watch a movie or video, listen to music, or videoconference with family and friends without needing to hold the electronic device.

As noted above, the support stand 10 includes at least one set-up condition designed for holding an electronic device, regardless of the device's size or shape. In accordance with embodiments of the present invention, one set-up position comprises the arm portion 30 of the support stand 10 being pivoted away from the base portion 20 to a generally upwardly extending position relative to the base portion 20, whereby the base portion 20 supports the bottom of an electronic device held by the support stand 10 and the arm portion 30 supports the back of the electronic device. In this regard, the arm portion 30 can be bent at the intermediate pivot 36 as desired so that the arm portion 30 can adequately support the back, or alternately the top, of the electronic device. For example, the first section 32 of the arm portion 30 can be pivoted down towards the base portion 20 at the rear pivot point and the second section 34 can be pivoted back at the intermediate pivot 36, such as shown in FIG. 4, so that the second section 34 can be aligned with the plane of the back of the electronic device. Alternately, the second section 34 of the arm portion 30 can be pivoted forward from the intermediate pivot, such as shown in FIG. 8, to touch the top of the electronic device—perhaps a device having a generally smaller footprint, such as a smart phone or music player.

In accordance with additional embodiments of the present invention, another set-up position comprises the first and second sections 22 and 24 of the base portion 20 being transversely pivoted away from one another, as shown in FIGS. 1-2, whereby the base portion 20 supports the bottom of an electronic device held by the support stand 10 and the arm portion 30 supports the back of the electronic device. Preferably, the first and second sections 22 and 24 are easily adjustable to various positional relationships between the extremes shown in FIGS. 2 and 5, permitting the set-up condition of the support stand 10 to accommodate various sizes and shapes of electronic devices as necessary—e.g., the wider the device, the wider apart the first and second sections 22 and 24 can be positioned. For example, FIG. 9 shows the sections 22 and 24 arranged at an intermediate set-up position to hold an electronic device. Again, the arm portion 30 can itself be pivoted to further accommodate the shape and size of the electronic device, as discussed above.

When the support stand 10 is not needed, it can be collapsed to a folded condition for easy transport and/or storage as shown in FIGS. 10-11. In accordance with embodiments of the present invention, the folded condition of the support stand 10 comprises the arm portion 30 being pivoted to a position adjacent to and generally parallel to the base portion 20, preferably nested on top of the base portion 20 within a notch formed between the rear horizontal pivot point and the speakers 40 positioned in the front of the base portion 20, as shown in FIG. 11. Where the base portion 20 comprises first and second sections 22 and 24, the sections are pivoted together when the support stand 10 is in its folded condition, as shown in FIG. 10.

Referring to FIG. 2, skid pads 42 can be provided on the upper surface of the base portion 20 to prevent slipping of the electronic device. Preferably, the skid pads 42 are made of a polymeric material that imparts sufficient friction to the bottom of the electronic device so that it will not slide along the upper surface of the base portion 20 when it is propped up on the support stand 10. A similar skid pad 44 or non-slip material can be provided on the arm portion 30 to impart friction between the arm portion 30 and the back or top-side of the electronic device.

Figure 5:
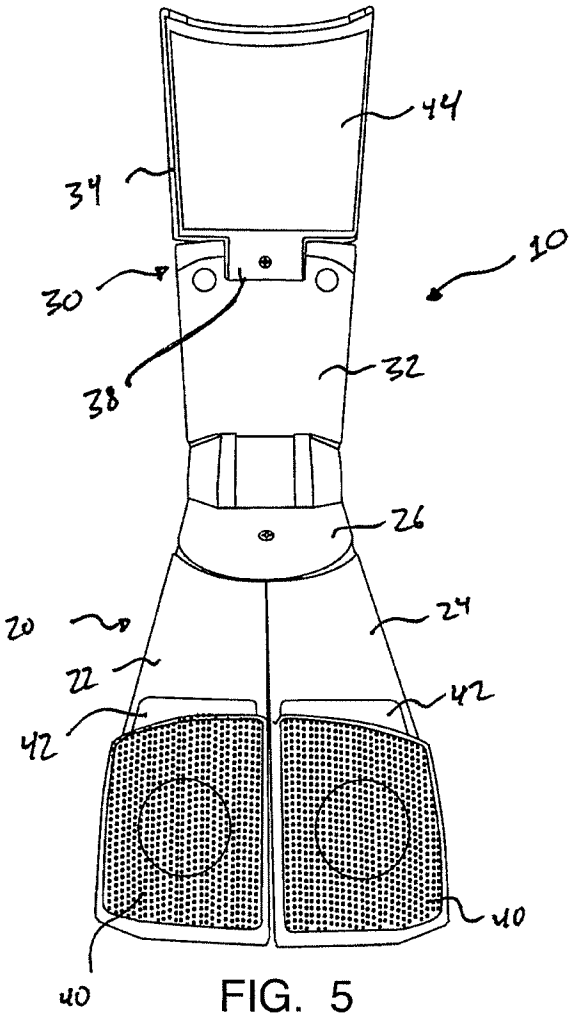
FIG. 5 shows a planar front view of the support stand of FIG. 1 in an alternate set-up condition.

As also shown in FIG. 5, a stop 46 can be formed in the base portion 20 to provide a surface against which the electronic device can be placed to prevent undesired slipping of the device during use on the support stand 10.

In alternate designs of the present invention, the base portion 20 can be a single piece that is not separable. In operation, the set-up condition of such a support stand mirrors that illustrated in FIG. 5 and the folded condition mirrors that illustrated in FIG. 10. Movement of the stand between a folded condition and a set-up condition essentially entails pivoting the arm portion 30 away from and together with the base portion 20.

In additional alternate designs of the present invention, the speaker system of the support stand can be used with an electronic device to transmit audio signals transmitted therefrom via the speaker system without placing the electronic device on the support stand. In general, so long as the speaker system is paired with the electronic device, audio signals can be projected via the speaker system. In this regard, the speaker system in any embodiments described herein can continue to transmit audio signals from the electronic device even if the electronic device is removed from, or even placed on the support stand, during use of the electronic device.

Referring to FIGS. 11-12, the support stand 10 further includes a power interface 50 for turning the support stand 10 on and off, an auxiliary port 52 for transmitting audio signals to an electronic component connected thereto, such as headphones, and a power input interface, such as micro-USB port 54, for directly powering the support stand 10 from an external power source or for recharging an internal battery unit 68, preferably a Lithium-Ion battery, disposed within the stand 10, from such an external power source.

In preferred embodiments of the present invention, the support stand 10 allows a portable electronic device to operate as a hands-free entertainment device that enables a user to display and transmit multimedia content via the device and a speaker system included in the support stand 10 without requiring the user to hold the electronic device during use. The support stand 10 operatively communicates with electronic devices using the wireless communications interface 60, such as a Bluetooth® or other short-range wireless network. Operational electronic components and circuitry for using the support stand 10 are maintained within the stand 10, and generally include a microprocessor or controller (e.g., CPU) for controlling the speaker system's electronics, a power supply (e.g., the rechargeable internal battery unit), requisite memory (e.g., ROM, RAM, flash memory), components for receiving audio signals from the electronic device (e.g., antenna, receiver, transmitter, transceiver, etc.), and a circuit board and an appropriate audio circuit for handling audio signals received by the support stand 10.

The foregoing description of embodiments of the present invention has been presented for the purpose of illustration and description. It is not intended to be exhaustive or to limit the invention to the form disclosed. Obvious modifications and variations are possible in light of the above disclosure. The embodiments described were chosen to best illustrate the principles of the invention and practical applications thereof to enable one of ordinary skill in the art to utilize the invention in various embodiments and with various modifications as suited to the particular use contemplated.

What is claimed is:

1. A support stand for displaying and transmitting multimedia content from a portable electronic device, said support stand comprising:

a first support member for supporting a lower portion of the electronic device, said first support member comprising a first section and a second section pivotally separable about a vertical axis between a first position where said first and second sections are generally parallel and adjacent each other and a second position where respective distal ends of said first and second sections are spread apart from one another along a lateral direction orthogonal to the vertical axis;

a second support member pivotally connected to the first support member and adjustable relative to the first support member around a laterally extending axis to a plurality of positions for supporting an upper portion of the electronic device; and at least one speaker disposed in the support stand and wirelessly connectable to the electronic device via a wireless interface.

2. The support stand as claimed in claim 1, wherein the first and second sections are movable to a plurality of set-up positions between the first position and the second position.

3. The support stand as claimed in claim 1, wherein a speaker is disposed in each of the first and second sections of the first support member.

4. The support stand as claimed in claim 1, further comprising at least one set-up condition where the second support member is pivoted away from the first support member to a generally outwardly extending position relative to the first support member; and a folded condition where the second support member is disposed adjacent to and generally parallel to the first support member.

5. The support stand as claimed in claim 1, wherein said second support member comprises a first section and a second section pivotally moveable relative to one another about a laterally extending intermediate pivot disposed between said sections.

6. The support stand as claimed in claim 5, wherein the first and second sections of said second support member are adjustable relative to one another about the intermediate pivot to a variety of positions in order to accommodate electronic devices of varying shapes and sizes.

7. The support stand as claimed in claim 1, wherein at least one of the first support member and the second support member includes at least one of a skid pad and a stop to prevent slipping of the electronic device positioned on the support stand.

8. A support stand for displaying and transmitting multimedia content from a portable electronic device, said support stand comprising:

a base portion for supporting a lower portion of the electronic device, said base portion comprising a first section and a second section pivotally movable relative to one another around a vertical axis between a first position where said first and second sections are generally parallel and adjacent and a second position where respective distal ends of said first and second sections are spread apart from one another along a lateral direction orthogonal the vertical axis;

an arm portion pivotally connected to the base portion and adjustable to a plurality of positions relative to the base portion for supporting an upper portion of the electronic device, said arm portion further comprising a first section and a second section pivotally moveable relative to one another about an intermediate pivot disposed between said sections to a variety of positions in order to accommodate electronic devices of varying shapes and sizes; and at least one speaker disposed in the support stand and wirelessly connectable to the electronic device via a wireless interface.

9. The support stand as claimed in claim 8, wherein the first and second sections are movable to a plurality of set-up positions between the first position and the second position.

10. The support stand as claimed in claim 8, wherein a speaker is disposed in each of the first and second sections of the base portion.

11. The support stand as claimed in claim 8, further comprising at least one set-up condition where the arm portion is pivoted away from the base portion to a generally upwardly extending position relative to the base portion; and a folded condition where the arm portion is disposed adjacent to and generally parallel to the base portion.

12. The support stand as claimed in claim 8, wherein at least one of the base portion and the arm portion includes at least one of a skid pad and a stop to prevent slipping of the electronic device positioned on the support stand.

13. The support stand as claimed in claim 8, wherein the intermediate pivot is laterally extending.

14. A support stand for displaying and transmitting multimedia content from a portable electronic device, said support stand comprising:

a base portion for supporting a lower portion of the electronic device, said base portion comprising a first section and a second section pivotally adjustable relative to one another around a vertical axis to a plurality of positions ranging between a first position where said first and second sections are generally parallel to a second position where respective distal ends of said first and second sections are spread apart from one another along a lateral direction transverse the vertical axis;

an arm portion pivotally connected to the base portion and adjustable around a laterally extending axis to a plurality of positions relative to the base portion for supporting an upper portion of the electronic device, said arm portion comprising a first section and a second section that are pivotally moveable relative to one another about a laterally extending intermediate pivot disposed between said sections; and at least one speaker disposed in the support stand and wirelessly connectable to the electronic device via a wireless interface.

15. The support stand as claimed in claim 14, wherein a speaker is disposed in each of the first and second sections of the base portion.

16. The support stand as claimed in claim 14, further comprising at least one set-up condition where the arm portion is pivoted away from the base portion to a generally upwardly extending position relative to the base portion; and a folded condition where the arm portion is disposed adjacent to and generally parallel to the base portion.

17. The support stand as claimed in claim 14, wherein the first and second sections of said arm portion are adjustable relative to one another about the intermediate pivot to a variety of positions in order to accommodate electronic devices of varying shapes and sizes.

18. The support stand as claimed in claim 14, wherein at least one of the base portion and the arm portion includes at least one of a skid pad and a stop to prevent slipping of the electronic device positioned on the support stand.

* * * * *